US011350685B2

(12) United States Patent
Denu et al.

(10) Patent No.: US 11,350,685 B2
(45) Date of Patent: Jun. 7, 2022

(54) NIGHTCAP AND METHOD OF APPLYING THE SAME

(71) Applicants: Vivianne B. Denu, Sandy Springs, GA (US); Constance Jeanette Berkley, Sandy Springs, GA (US)

(72) Inventors: Vivianne B. Denu, Sandy Springs, GA (US); Constance Jeanette Berkley, Sandy Springs, GA (US)

( * ) Notice: Subject to any disclaimer, the term of this patent is extended or adjusted under 35 U.S.C. 154(b) by 0 days.

(21) Appl. No.: 16/949,547

(22) Filed: Nov. 3, 2020

(65) Prior Publication Data

US 2022/0132968 A1 May 5, 2022

(51) Int. Cl.
*A42B 1/049* (2021.01)
*A42B 1/041* (2021.01)

(52) U.S. Cl.
CPC ..... *A42B 1/049* (2021.01); *A42B 1/041* (2013.01)

(58) Field of Classification Search
CPC ..... A42B 1/041; A42B 1/049; A42B 1/045; A42B 1/012; A42B 1/04; A42B 1/206; A42B 1/22; A42B 1/0186; A42B 1/06; A42B 5/00; A42B 7/00; A45D 8/40; A42C 5/00
USPC ..... 2/174, 202, 204, 207
See application file for complete search history.

(56) References Cited

U.S. PATENT DOCUMENTS 1,602,889 A * 10/1926 Epstein ..... A42B 1/22 2/171.03
1,652,723 A * 12/1927 Mason ..... A42B 1/22 2/195.7
1,685,190 A * 9/1928 Curtis ..... A42B 1/041 2/171.01
1,720,560 A * 7/1929 Lipper ..... A42B 1/041 2/195.8
1,749,340 A * 3/1930 Grean ..... A42B 1/041 2/195.7
1,920,387 A * 8/1933 Harper ..... A42B 1/12 2/68
2,107,951 A 2/1938 Lipton
2,268,422 A * 12/1941 Rogers ..... A42B 1/041 2/204
2,336,356 A * 12/1943 Harding ..... A42B 1/041 2/204

(Continued)

FOREIGN PATENT DOCUMENTS

GB 345857 A * 4/1931 ..... A42B 1/041
GB 392455 A * 5/1933 ..... A42B 1/045

*Primary Examiner* — Amy Vanatta
(74) *Attorney, Agent, or Firm* — Dunlap Bennett & Ludwig, PLLC; Brendan E. Squire

(57) ABSTRACT

A nightcap configured for securing about a wearer's head and method of wearing the same is disclosed. The nightcap includes a cap portion that is dimensioned to cover a wearer's head. An aft end of the cap portion encircles a wearer's head. A forward end of the cap portion has a notch proximal to a top end of the cap portion by a confluence of an upper edge of a pair of elongate straps distending from the cap portion. Side loops are provided at the lateral sides of the cap portion and a rear loop is provided at an aft end of the cap portion. The cap is worn and secured about the wearer's head by encircling the wearer's head with the elongate straps, while routing terminal ends of the elongate straps through the side loops, rear loop, and securing the straps in a knot on the wearer's forehead.

4 Claims, 4 Drawing Sheets

(56) References Cited

U.S. PATENT DOCUMENTS

| | | | | | |
|---|---|---|---|---|---|
| 2,653,326 | A | | 9/1953 | Ged | |
| 2,694,204 | A | * | 11/1954 | Cross | A45D 20/00 2/174 |
| 4,462,117 | A | * | 7/1984 | Brunelle | A42B 1/041 2/202 |
| 5,083,318 | A | * | 1/1992 | Hook | A42B 1/041 2/174 |
| 5,365,613 | A | | 11/1994 | Henegan | |
| 5,490,528 | A | | 2/1996 | Day | |
| 5,621,919 | A | | 4/1997 | Graham | |
| 6,092,239 | A | | 7/2000 | Pogrebitsky et al. | |
| 6,247,181 | B1 | | 6/2001 | Hirsch et al. | |
| 6,560,784 | B2 | | 5/2003 | Hill | |
| 6,735,783 | B2 | | 5/2004 | Phillips | |
| 7,836,522 | B2 | | 11/2010 | Blecha | |
| 8,316,466 | B2 | | 11/2012 | Saito | |
| 9,504,362 | B1 | | 11/2016 | Skinner | |
| 9,907,381 | B2 | | 3/2018 | Tussey | |
| 2002/0104150 | A1 | * | 8/2002 | Hill | A42B 1/041 2/174 |
| 2003/0070208 | A1 | | 4/2003 | Magdziak-Hautala | |
| 2007/0214545 | A1 | | 9/2007 | Rhodes | |
| 2009/0126078 | A1 | | 5/2009 | Rashid | |
| 2016/0198830 | A1 | * | 7/2016 | Tussey | A45D 8/40 2/183 |
| 2018/0332917 | A1 | * | 11/2018 | Wonsey | A42B 1/041 |
| 2019/0037944 | A1 | * | 2/2019 | Tussey | A42B 1/18 |

* cited by examiner

NIGHTCAP AND METHOD OF APPLYING THE SAME

BACKGROUND OF THE INVENTION

The present invention relates to headwear, and more particularly to night caps for sleeping.

Conventional night caps are prone to slipping off the wearer's head during the night and mess up the user's hair. This cap is designed to stay on your head all night long.

Other nightcaps use simple knots, where the wearer ties the ends of the nightcap in a simple knot, with no locking process.

As can be seen, there is a need for an improved nightcap that is designed to stay on the wearer's head all night long.

SUMMARY OF THE INVENTION

In one aspect of the present invention, a nightcap configured for securing about a wearer's head is disclosed. The nightcap includes a cap portion that is dimensioned to cover a wearer's head. An aft end of the cap portion is configured to encircle a wearer's head and extends to a lower edge that extends laterally across a nape of the wearer's neck. A forward end of the cap portion has a notch defined proximal to a top end of the cap portion by a confluence of an upper edge of a pair of elongate straps distending from the cap portion. An apex of the notch is formed so that it is positioned proximal to a hairline across a forehead of the wearer's head.

The elongate straps are formed in a triangular shape having a base at the cap portion and converging to a distal terminal end. A lower edge of the elongate straps extend along a line of the lower edge of the aft end of the cap portion. An upper edge of the elongate straps converges towards the lower end of the elongate straps between the notch and the distal terminal end. The elongate straps have a length between the base and the distal terminal ends dimensioned to encircle the wearers head and form a knot at the wearer's forehead.

In some embodiments, the lower edge of the elongate straps are substantially aligned with the lower edge of the aft end of the cap portion when positioned around the nape of the wearer's neck.

In some embodiments, a side loop is attached along the lower edge of the cap portion proximal to a wearer's ear lobes. The side loop may be attached to provide for a lateral orientation of an opening of the side loop.

In other embodiments, a rear loop is attached to the lower edge at the aft end of the cap portion. The rear loop is attached to provide a vertical orientation of an opening of the aft loop.

In other aspects of the invention, a method of securing a night cap on a wearers' head is disclosed. The method includes placing a cap portion of the night cap on the wearers head. The cap portion has a side loop attached at opposed lateral sides of the cap portion and a rear loop disposed at an aft end of the cap portion. A pair of elongate straps are oriented to extend from opposite sides of the cap portion in a forward orientation. A terminal end of each of the pair of elongate straps is threaded through the side loop on the opposed lateral side. The terminal end of each of the pair of elongate straps is then threaded through the rear loop. Each of the elongate straps are routed forwardly along a base of the cap portion. The terminal end of each of the pair of elongate straps is then threaded through the side loop on a same lateral side as an origin each of the pair of elongate straps. The pair of elongate straps are then tied in a knot across the forehead of the wearer. The method may also include the step of cinching the pair of elongate straps about the wearer's head prior to the step of tying. The method may also include untying the knot to release the pair of elongate straps. The nightcap may then be removed the night cap from the wearer's head.

These and other features, aspects and advantages of the present invention will become better understood with reference to the following drawings, description and claims.

DETAILED DESCRIPTION

Figure 1:
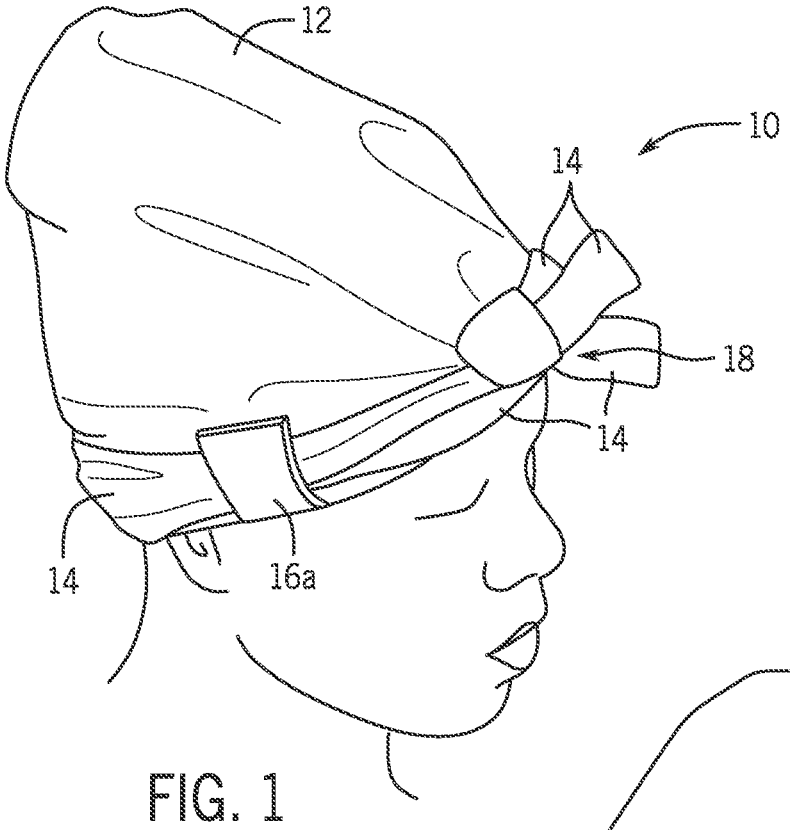
FIG. 1 is a perspective view of the invention in use.
Figure 4:
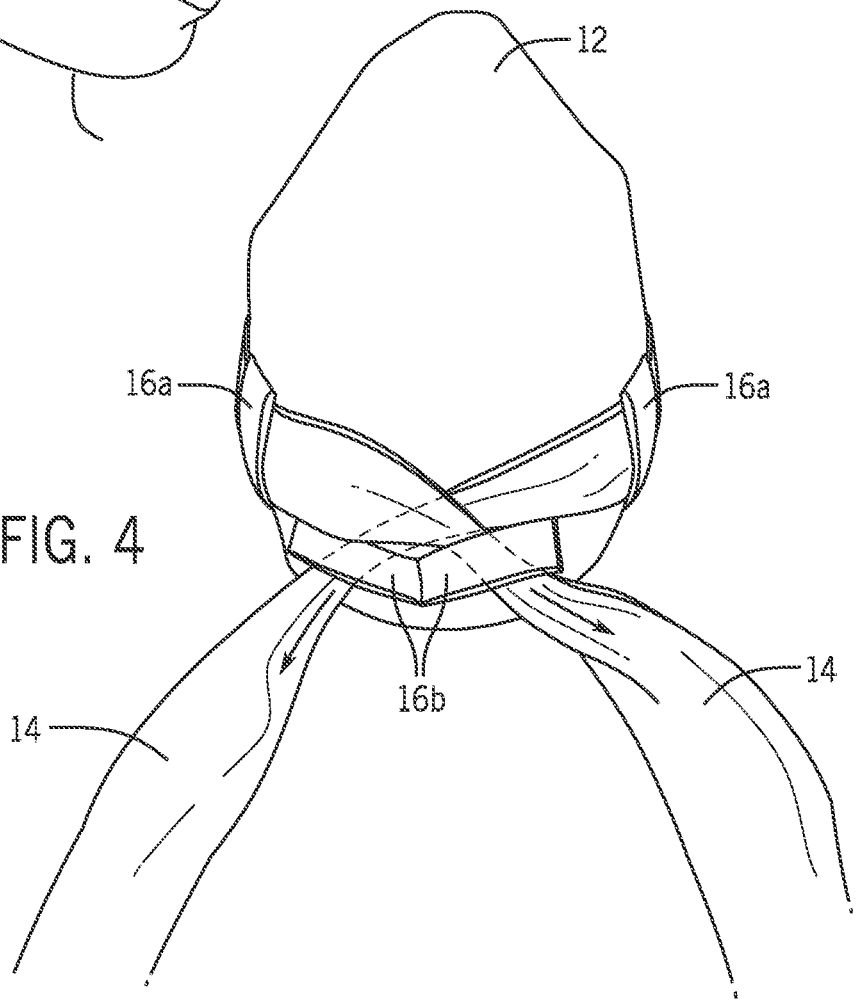
FIG. 4 is a rear perspective view of the invention showing the first step of cross-tying the strap portion of the invention.
Figure 2:
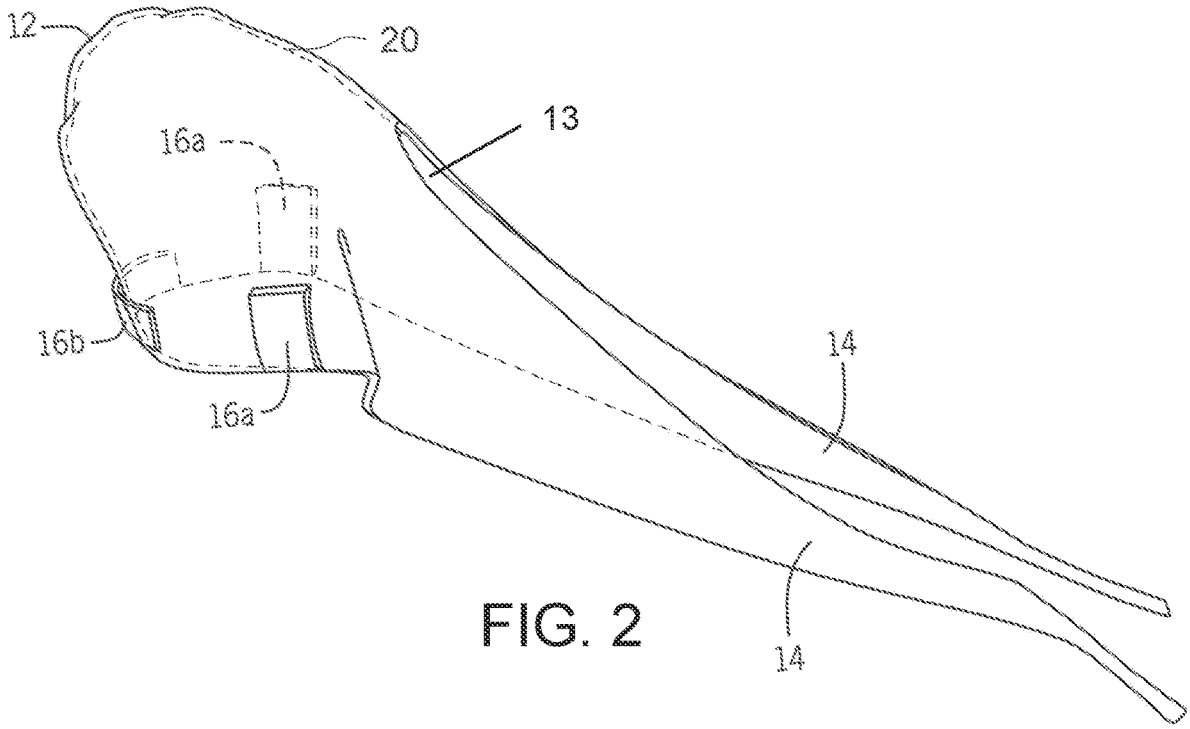
FIG. 2 is perspective view of the invention.
Figure 3:
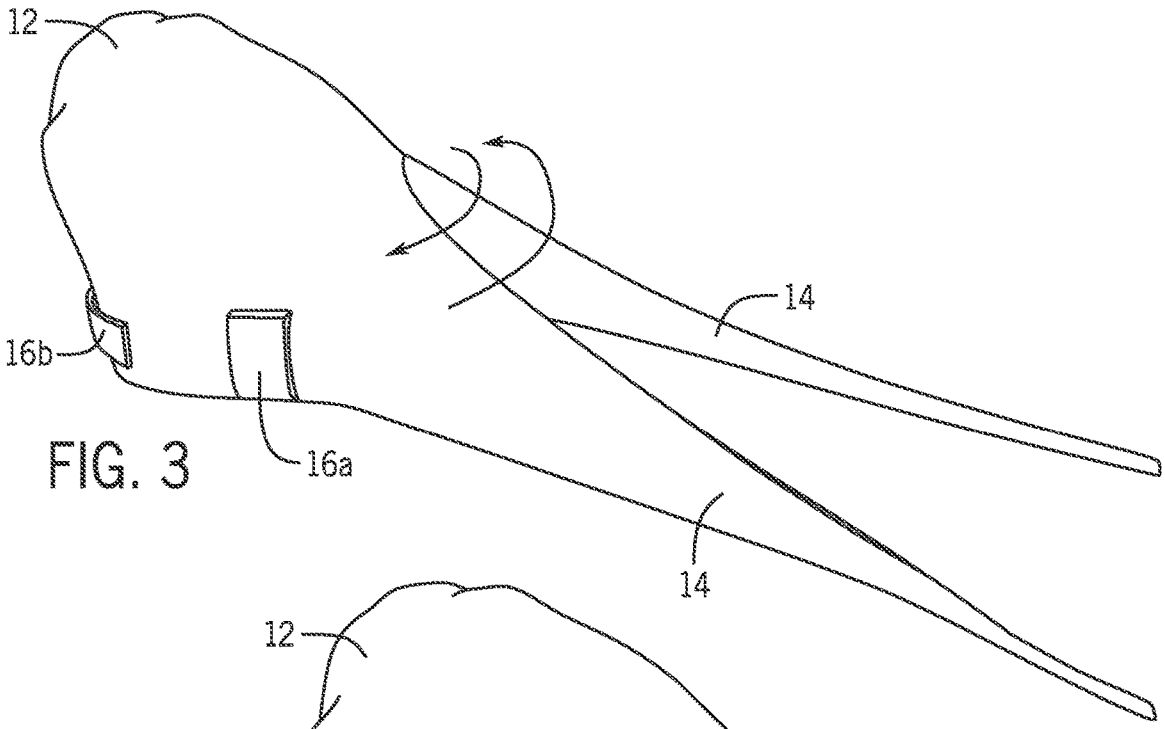
FIG. 3 is another perspective view of the invention, similar to FIG. 2, indicating the first step of cross-tying the strap portion of the invention.
Figure 5:
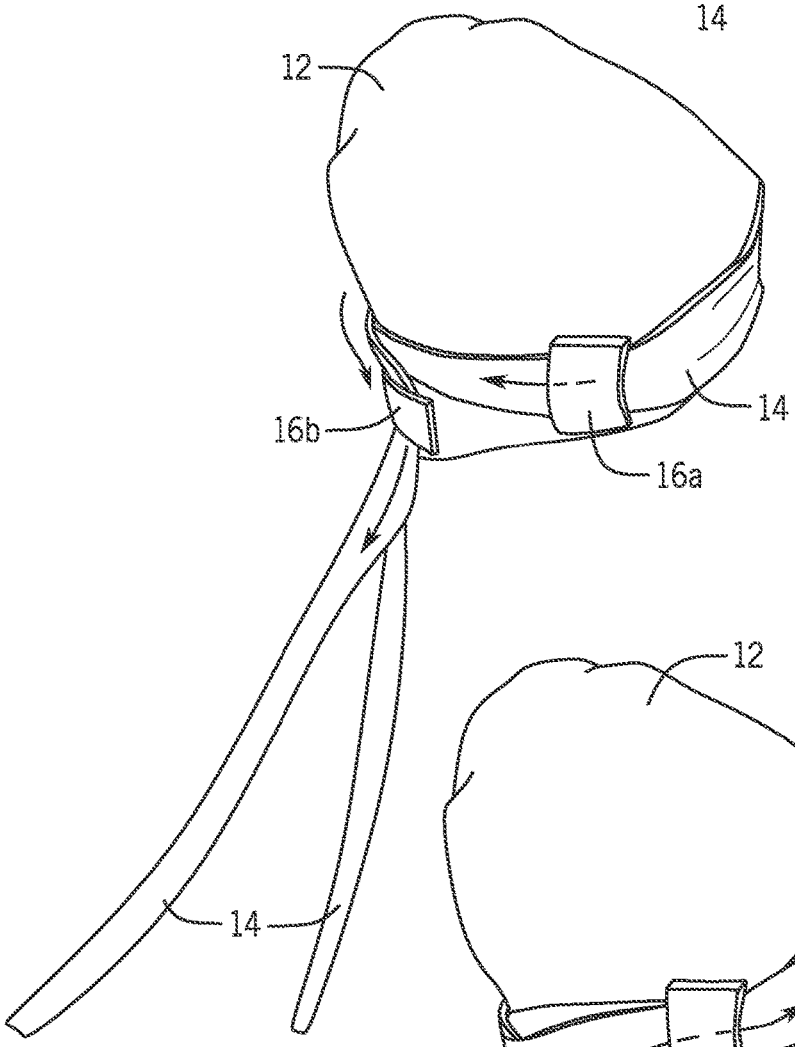
FIG. 5 is a side perspective view, similar to FIG. 3, showing the second step of cross-tying the strap portion of the invention.
Figure 6:
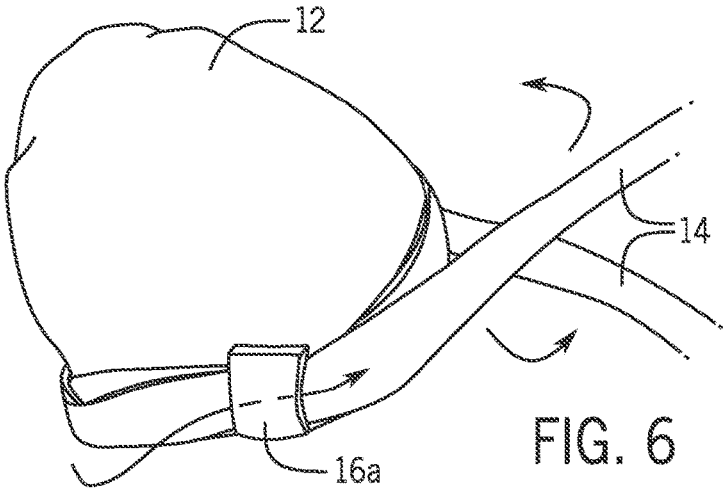
FIG. 6 is side perspective view, similar to FIG. 5, showing the third step of cross-tying the strap, before tying the knot.

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides an apparatus and method for protecting a wearer's hair while sleeping.

As seen in reference to the drawings of FIGS. 1-5, a nightcap 10 according to aspects of the present invention is shown. The nightcap 10 includes a cap portion 12 that is dimensioned to cover a wearer's head. An aft end of the cap portion 12 is configured to encircle a wearer's head and extends to a lower edge that extends laterally across a nape of the wearer's neck.

A forward end of the cap portion 12 has a notch 13 defined proximal to a top end of the cap portion 12 by a confluence of an upper edge of a pair of elongate straps 14 distending from the cap portion 12. An apex of the notch 13 is formed so that it is positioned proximal to a hairline across a forehead of the wearer's head.

The elongate straps 14 are formed in a triangular shape having a base at the cap portion 12 and converging to distal terminal ends. A lower end of the elongate straps 14 extend from the along a line of the lower edge of the aft end of the cap portion 12. In a preferred embodiment, the lower end of the elongate straps 14 are substantially aligned with the lower edge of the aft end of the cap portion when positioned around the nape of the wearer's neck. An upper edge of the elongate straps 14 converges towards the lower end of the elongate straps 14 between the notch and the distal terminal ends. The elongate straps 14 have a length between the base and the distal terminal ends dimensioned to encircle the wearers head and form a knot 18 at the wearer's forehead.

A left and a right side loops 16*a* are attached along the lower edge of the cap portion 12 proximal to a wearer's ear lobes. The side loops 16*a* are attached to provide for a lateral orientation of an opening of the side loops 16*a*. A rear loop 16*b* is attached to the lower edge at the aft end of the cap portion 12. The rear loop 16*b* is attached to provide a vertical orientation of an opening of the aft loop 16*b*.

The side loops 16*a* and aft loop 16*b* are dimensioned to threadingly receive the elongate straps 14 when wrapped around the wearer's head. The side loops 16*a* and aft loop 16*b* retain the encircling elongate straps 14 in position with the cap portion 12 to define a cinching band of the nightcap 10 and to secure the night cap 10 snugly to the wearer's head. In some embodiments, a stitch may be applied to the rear loop 16*b* to provide two channels, one for each elongate strap 14 to provide separation of the respective elongate straps 14 when wrapped about the wearer's head for improved cinching of the cinching band.

A method of attaching the night cap 10 includes placing the cap portion 12 on the wearer's head with the elongate straps 14 positioned in a forward orientation. The elongate straps 14 are wound around the wearer's forehead and the terminal ends are threaded through the side loop 16*a* on the opposite side of the cap portion 12 from the respective elongate straps 14. The terminal ends are then routed to the back of the cap portion 12 and threaded through the rear loop 16*b*, preferably from a top opening of the rear loop 16*b* to a bottom opening of the rear loop 16*b*. The terminal ends of the elongate straps 14 are then routed through the adjacent side loop 16*a* and drawn to snug the elongate straps 14 at a comfortable tension to retain the night cap 10 on the wearer's head. The elongate straps 14 are then tied in a knot at a front end of the night cap 10.

Figure 7:
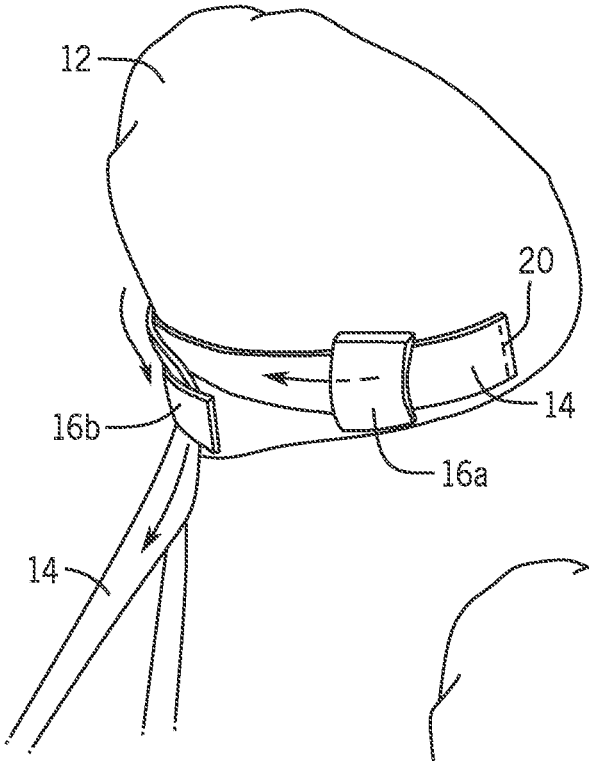
FIG. 7 is a side perspective view of an alternate configuration, of the invention.
Figure 8:
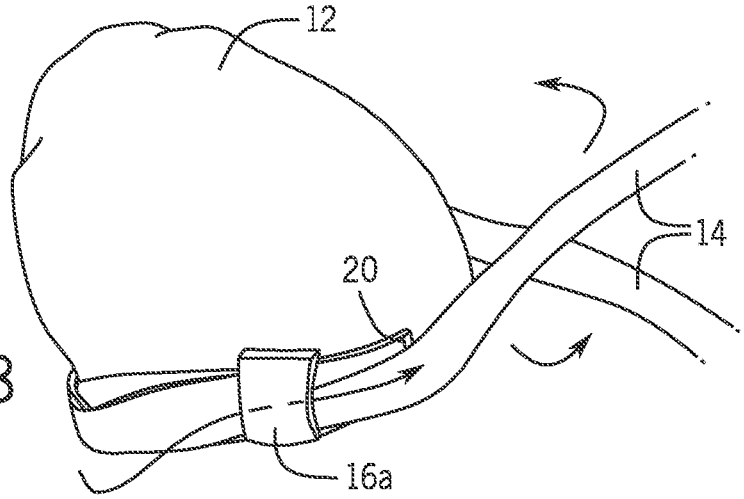
FIG. 8 shows a mode in which the straps are threaded from the back of the hat to the front.
Figure 9:
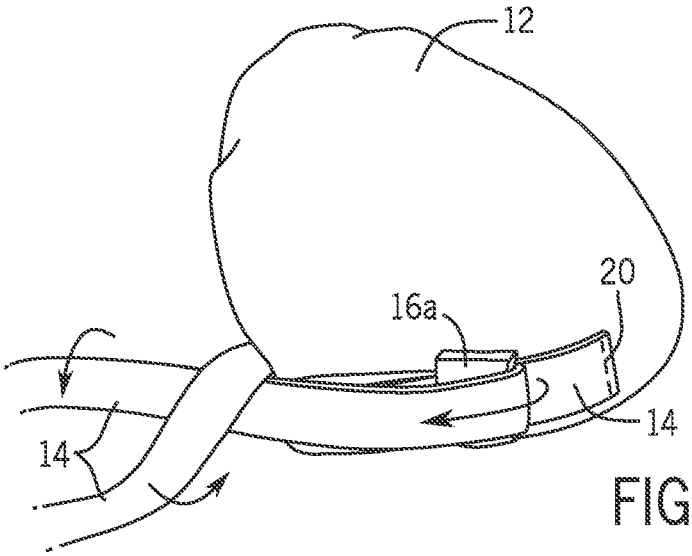
FIG. 9 shows a mode in which the straps are threaded from the back of the hat to the front, and then looped back for tying in the back.

In an alternative embodiment, show in in reference to FIGS. 7-9, the elongate straps 14 are secured to the cap portion 12 forwardly of the side loops 16*a*. In this embodiment, the elongate straps are routed aftward through the adjacent side loop 16*a*. and through the rear loop 16*b*. The ends of the elongate straps may then be tied in a knot at the nape of the wearer's neck.

It should be understood, of course, that the foregoing relates to exemplary embodiments of the invention and that modifications may be made without departing from the spirit and scope of the invention as set forth in the following claims.

What is claimed is:

1. A method of securing a night cap on a wearer's head, comprising:

placing a cap portion of the night cap on the wearer's head, the cap portion having a side loop attached at opposed lateral sides of the cap portion, and a rear loop disposed at an aft end of the cap portion;

orienting a pair of elongate straps extending from opposite sides of the cap portion in a forward orientation;

threading a terminal end of each of the pair of elongate straps through the side loop on the opposed lateral side;

threading the terminal end of each of the pair of elongate straps through the rear loop;

routing the each of the elongate straps forwardly along a base of the cap portion;

threading the terminal end of each of the pair of elongate straps through the side loop on a same lateral side as an origin each of the pair of elongate straps; and tying the pair of elongate straps in a knot across a forehead of the wearer.

2. The method of claim 1, further comprising:

cinching the pair of elongate straps about the wearer's head prior to the step of tying.

3. The method of claim 2, further comprising:

untying the knot to release the pair of elongate straps.

4. The method of claim 3, further comprising:

removing the night cap from the wearer's head.

* * * * *